US007013020B2

(12) United States Patent
Ito et al.

(10) Patent No.: US 7,013,020 B2
(45) Date of Patent: Mar. 14, 2006

(54) SPEAKER CABINET

(75) Inventors: Shin Ito, Shizuoka-ken (JP); Shinichi Yamashita, Shizuoka-ken (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/857,771

(22) Filed: May 28, 2004

(65) Prior Publication Data

US 2005/0008187 A1 Jan. 13, 2005

(30) Foreign Application Priority Data

May 29, 2003 (JP) ..... 2003-152165

(51) Int. Cl.
*H04R 25/00* (2006.01)

(52) U.S. Cl. ..... 381/386; 381/336; 381/345

(58) Field of Classification Search ..... 381/87, 381/386, 391, 189, 345, 162, 333, 334, 336; 181/198, 199; 156/196, 257, 268; 428/109, 428/167, 168, 172, 188
See application file for complete search history.

(56) References Cited

U.S. PATENT DOCUMENTS 6,706,369 B1 * 3/2004 Thomsen ..... 428/172

FOREIGN PATENT DOCUMENTS

| | | |
|---|---|---|
| JP | 05-153681 | 6/1993 |
| JP | 06-351088 | 12/1994 |
| JP | 07-030987 | 1/1995 |
| JP | 10-322787 | 12/1998 |
| JP | 2002-252891 | 9/2002 |
| JP | 2003-116189 | 4/2003 |

OTHER PUBLICATIONS

Kef Catalog, "UNI-Q Loudspeakers", Jun. 2002.

* cited by examiner

*Primary Examiner*—Huyen Le
(74) *Attorney, Agent, or Firm*—Pillsbury Winthrop Shaw Pittman LLP

(57) ABSTRACT

Side plates, constituting side surfaces of a speaker cabinet, each comprise a base member having a plurality of grooves formed in its outer surface (obverse surface) region at predetermined intervals, and a decorative plate adhesively bonded to the outer surface of the base member, in a laminated fashion, so as to cover the grooves. The laminated base member and decorative plate are pressed and curved, via upper and lower molds, so as to provide a smooth, convexlycurved outer surface. The grooves are adhesively bonded along their opening edges to the inner surface of the decorative plate, so that the opening edges of each of the grooves will not move toward or away from each other when external force is applied to the side plate.

2 Claims, 4 Drawing Sheets

SPEAKER CABINET

BACKGROUND OF THE INVENTION

The present invention relates to speaker cabinets for audio equipment and the like.

As outer walls of speaker cabinets, there have been employed cabinet boards typically made by adhesively bonding a decorative sheet or plate to the surface of a relatively heavy and hard base member, such as a plywood board, single-panel sheet (in this case, veneer sheet) or particle board, in a laminated fashion. The thus made cabinet board is cut into predetermined sizes and shapes to provide a front plate, left and right side plates, back plate and bottom plate, and these plates are jointed together at their edges to thereby provide a speaker cabinet having a rectangular parallelepiped shape. The speaker cabinet has a front covered with a grill net, and various kinds of speakers are accommodated in the interior of the speaker cabinet. Such speaker cabinets are disclosed, for example, in Japanese Patent Application Laid-open Publication Nos. HEI-7-030987, HEI-10-322787, HEI-5-153681 and 2003-116189. Also known are speaker cabinets of other shapes than the rectangular parallelepiped shape, such as cylindrical and near-cylindrical shapes, which are formed by curving the cabinet board to have a convexly curved outer surface (i.e., obverse surface) (see, for example, Japanese Patent Application Laid-open Publication Nots. 2002-252891 and HEI-6-351088 and nonpatent literature "Q series Speaker Cabinet" by KEF Ltd.).

The precent invention particularly concerns one of the types of speaker cabinets which is at least partially formed of a cabinet board arcuately curved to have a convexly curved outer surface (i.e., obverse surface) and which is constructed to have a high mechanical strength and high-quality outer appearance.

FIG. 5 is a sectional view of an example of the conventional curved-type cabinet boards for use as an outer wall of a speaker cabinet. The cabinet board 1 is made by forming a base member 2 with four plywood hoards 2*a*–2*d* and adhesively bonding a decorative sheet 3 to the outer surface of the base member 2 in a laminated fashion. The thus-made cabinet board 1 is then pressed and arcuately curved by a press forming machine so that it assumes a convexly curved outer surface of a predetermined radius of curvature.

FIG. 6 is a sectional view of another example of the conventional curved-type cabinet boards. The cabinet board 7 comprises a base member 5 in the form of a veneer sheet, particle board or the like, which has a plurality of grooves 6 formed at predetermined intervals in its reverse side that makes the inner side of the speaker cabinet. The cabinet board also includes a decorative sheet 3 adhesively bonded to the outer surface of the base member 5. The cabinet board 7 is then pressed and arcuately curved by a press forming machine so that it assumes a convexly curved outer surface of a predetermined radius of curvature. The cabinet board 7 of this type is employed, for example, in speaker boxes manufactured by KEF Ltd. Because of the press-curving, each of the grooves 6 is formed into a relatively small opening width.

However, the conventional curved-type cabinet board 1 of FIG. 5, where a plurality of the plywood boards 2*a*–2*d* are used as the base member 2, is disadvantageous in that it achieves only low productivity and needs a large-size forming machine, because it not only has to undergo a considerable number of adhesive applying steps but also has to be subjected to great curving pressure for a long time due to its high rigidity.

On the other hand, the conventional curved-type cabinet board 7 of FIG. 6, which comprises a smaller number of components than the cabinet board 1 of FIG. 5 due to the provision of the grooves 6, is advantageous in that, by virtue of lower overall rigidity, it can be readily formed into a curved shape with a smaller pressing force. But, as the cabinet board 7 is press-curved, strese builds up concentratively in outer surface regions 9 of inter-groove portions 5*a* (i.e., non-grooved portions between the grooves 9) of the base member 5 which correspond to opposed side edges of the grooves 6. Thus, the base member 6 would be undesirably bent at the outer surface regions 9, so that the decorative sheet 3, formed of a polyvinyl chloride (PVC) or other flexible material, would also bend to leave undesired creases 10. Consequently, the cabinet board 7 can not have a high-quality, smooth convexly curved outer surface, which would result in a low-quality outer appearance of the cabinet. However, because a grain pattern is normally printed on the surface of the decorative sheet 3, the creases 10 would not be readily perceived visually and thus would be rarely recognized as significant defects.

Furthermore, the grooves 6, opening in the reverse side of the base member 5, decreases the rigidity of the cabinet board 7, and thus, acoustic characteristics of the speaker cabinet would be deteriorated if the grooves 6 vary in width as the cabinet itself resonates with sound waves radiated from a speaker diaphragm.

SUMMARY OF THE INVENTION

In view of the foregoing, it is an object of the present invention to provide an improved speaker cabinet which has high rigidity and shape stability and can improve acoustic characteristics, and which can present a high-quality outer appearance with smooth surfaces without any undesired crease appearing on the surfaces of decorative plates due to bending of base members.

In order to accomplish the above-mentioned object, the present invention provides a speaker cabinet in which at least a part of its outer wall is formed of a cabinet board curved to have a convexly curved outer surface. In the speaker cabinet of the invention, the cabinet board comprises: a base member having a plurality of grooves formed at predetermined intervals in an outer surface portion thereof, the base member being convexly curved in a direction where the grooves open; and a decorative plate adhesively bonded to the outer surface of the base member, in a laminated fashion, so as to cover the grooves.

In the present invention arranged in the aforementioned manner, the opening portions of the grooves are securely fixed by the decorative plate, so that enhanced rigidity and shape stability of the speaker cabinet can be achieved.

Further, the present invention can reliably prevent the grooves from varying in width due to resonance of the speaker cabinet, thereby effectively avoiding deterioration of acoustic characteristics.

Furthermore, the present invention can achieve a high-quality outer appearance of the speaker cabinet. Namely, as the cabinet board is pressed and curved, during its manufacture, to assume a predetermined convexly curved outer surface, stress would build up concentratively in some regions of portions between the grooves (i.e., intergroove portions) of the base member near the opposed side edges of the individual grooves, and these portions would undesirably bent due to the stress. The decorative plate, which has, no grooved portion, has considerable bending rigidity as compared to a decorative sheet, so that, as its: outer surface (obverse surface) side is pressed by a concavely curved mold, the outer and inner surfaces of the decorative plate are curved continuously arcuately in conformity with the concavely curved surface of the mold. On the other hand, part of the inner surface (i.e., reverse surface) of the decorative plate linearly contacts the bent near-side-edge regions of the base member, while the remaining part of the inner surface of the decorative plate arcuately floats above, i.e. do not directly contact, the outer surface of the intergroove portions. Such arrangements of the present invention can reliably prevent the near-side-edge outer regions of the curved base member from appearing as undesired creases on the outer surface of the decorative plate.

The following will describe embodiments of the present invention, but it should be appreciated that the present invention is not limited to the described embodiments and various modifications of the invention are possible without departing from the basic principles of the invention. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION OF THE INVENTION

Figure 1:
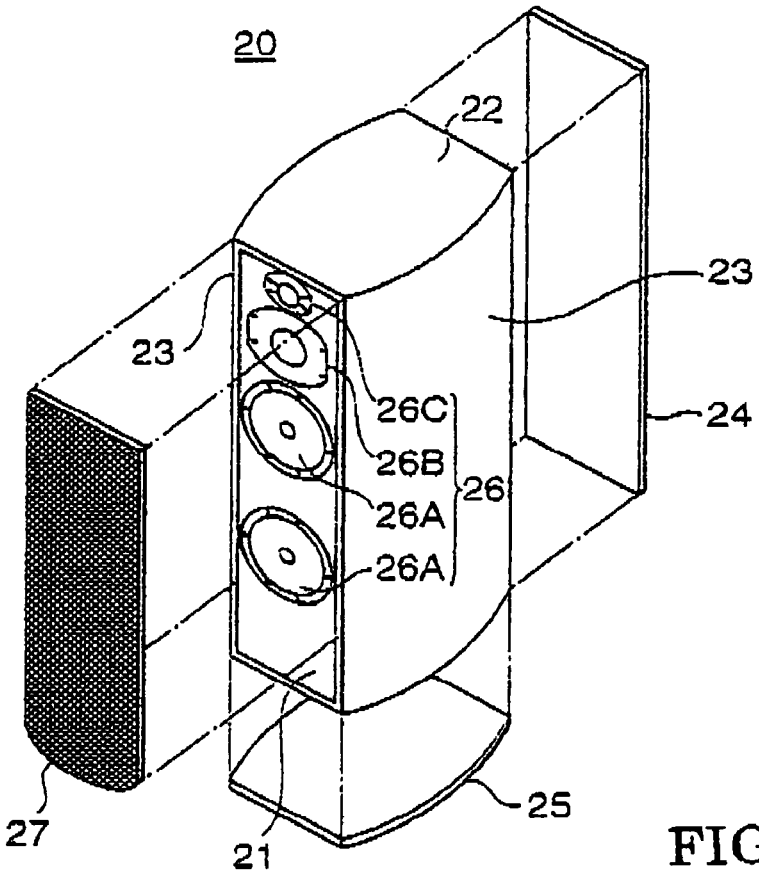
FIG. 1 is an exploded perspective view of a speaker cabinet in accordance with an embodiment of the present invention.
Figure 2:
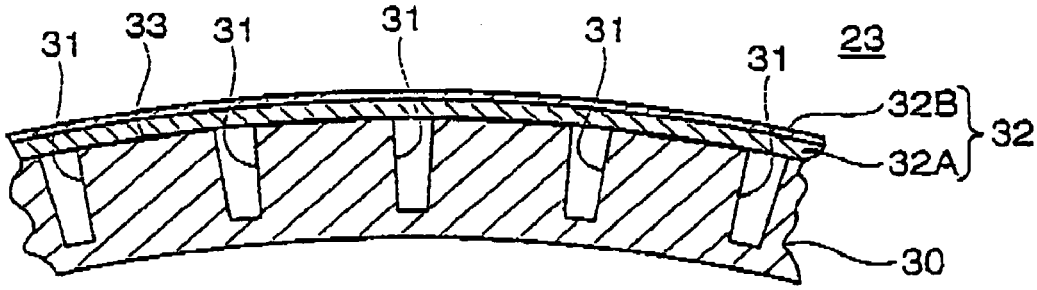
FIG. 2 is a sectional view showing a principal section of a side plate employed in the speaker cabinet of FIG. 1.
Figure 3:
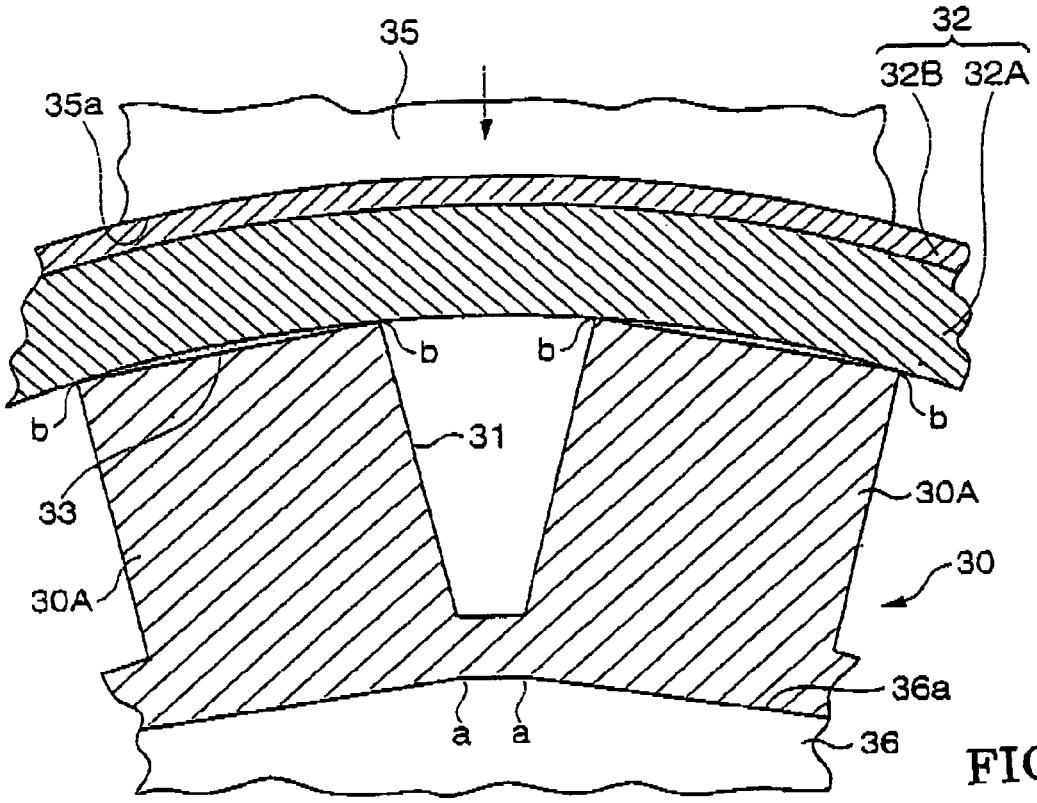
FIG. 3 is an enlarged sectional view of the side plate.

FIG. 1 is an exploded perspective view of a speaker cabinet in accordance with an embodiment of the present invention. FIG. 2 is a sectional view showing a principal section of a side plate employed in the speaker cabinet of FIG. 1, and FIG. 3 is an enlarged sectional view of the side plate.

In these figures, the speaker cabinet, generally represented by reference numeral 20, is in the shape of a vertically-elongated rectangular parallelepiped or box having six cabinet wall plates, i.e. a front plate 21, top plate 22, a pair of side plates 23, back plate 24 and bottom plate 25. To the front plate 21 are secured four speakers 26 of three different types and a grill net 27 covering the speakers 26. The four speakers 26 are two bass speakers 26A, one squawker speaker 26B and one tweeter speaker 26C.

Each of the front plate 21, top plate 22, side plates 23, back plate 24 and bottom plate 25 is formed by adhesively bonding a decorative sheet or plate to the outer surface of a relatively heavy and hard base member, such as a plywood board, single-panel sheet (in this case, veneer sheet) or particle board, in a laminated fashion. However, because the back plate 24 and bottom plate 25 are normally invisible from the outside, they may each comprise the base member with no decorative sheet or plate attached to its outer surface (i.e., obverse surface). Further, each of the front plate 21, top plate 22, back plate 24 and bottom plate 25 is in the shape of a flat plate, and each of the left and right side plates 23 is formed into an arcuately curved shape such that it has a convexly-curved outer surface similar, for example, to a part of a cylindrical or elliptic surface as viewed in plan.

As illustratively shown in FIG. 2, each of the side plates 23 includes the base member 30, in the form of a particle board, veneer sheet or the like, having a plurality of rectangular (or U-shaped) grooves 31 that are formed in its outer surface-side portion and spaced apart from each other at predetermined intervals in a front-andback direction of the speaker cabinet. Each of the grooves 31 opens outwardly of the base member 30. The side plate 23 also includes the decorative plate 32 covering the outer surface of the base member 30, and the side plate 23 is convexly curved in a direction where the grooves 31 open. The decorative plate 32 comprises a thin veneer plate 32A having an appropriate thickness and bending rigidity, and a decorative sheet 32B, such as a PVC sheet adhesively bonded to the outer surface of the veneer sheet 32A; the decorative sheet 32B may be replaced with a coating applied to the outer surface of the veneer sheet 32A.

The base member 30, veneer plate 32A and decorative sheet 32B have thicknesses of 12 mm, 3 mm and 0.2 mm, respectively.

Figure 4:
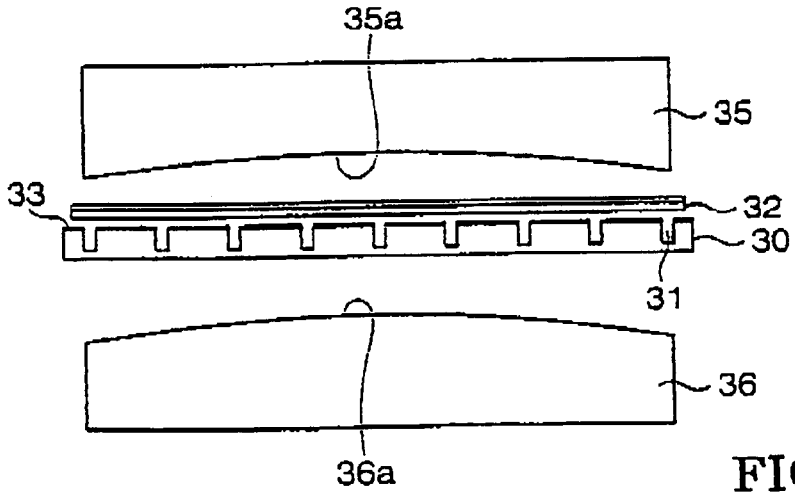
FIG. 4 is a view explanatory of how the side plate is formed into a curved configuration via a press forming machine.
Figure 5:
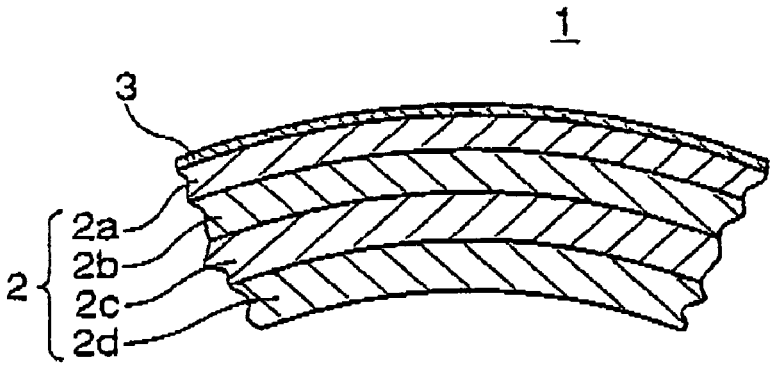
FIG. 5 is a sectional view of an example of a conventional curved-type cabinet board for use as an outer wall of a speaker cabinet.
Figure 6:
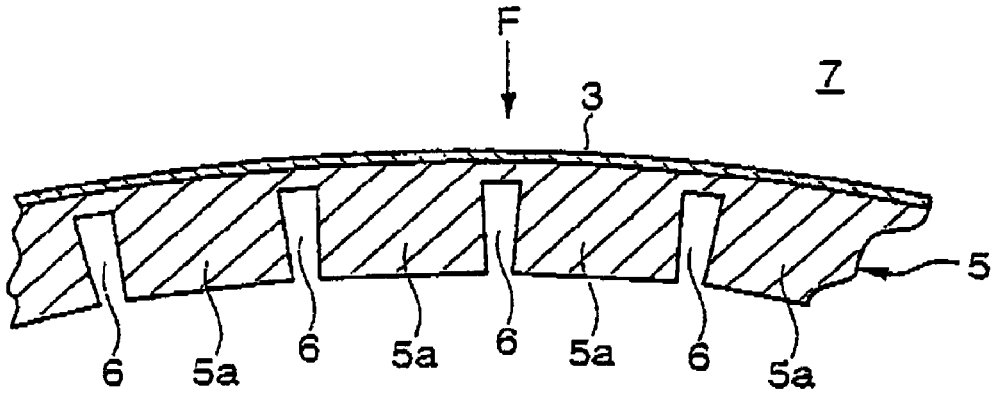
FIG. 6 is a sectional view of another example of a conventional curved-type cabinet board for use as an outer wall of a speaker cabinet.
Figure 7:
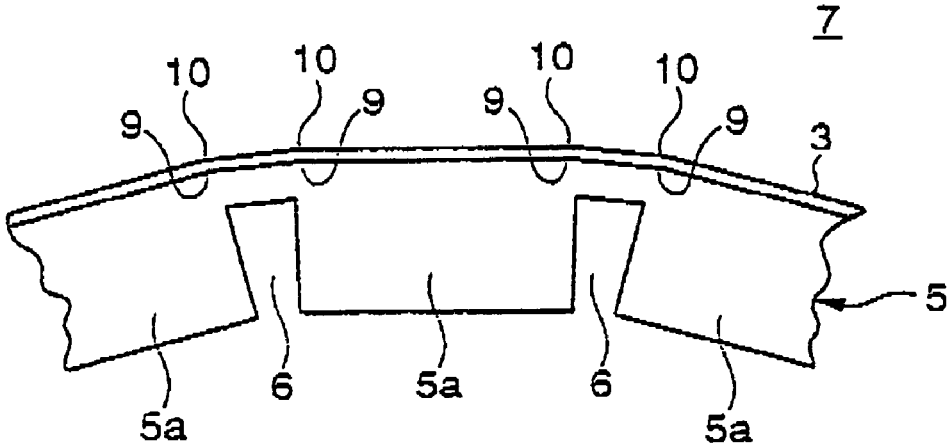
FIG. 7 is a sectional view illustrating creases left on the outer surface of a decorative sheet due to bending.

In manufacturing the side plate 23, an adhesive 33 is applied to the outer surface of the base member 30 and then the decorative plate 32 is placed on the base member 30, as illustrated in FIG. 4. Then, the thus-laminated base member 30 and decorative plate 32 are placed between upper and lower molds 35 and 36 of a press forming machine. The upper and lower molds 35 and 36 are opposed to each other at their respective pressing surfaces 35*a* and 36*a* shaped in complementary relation to each other, i.e. smooth concavely curved surface 35*a* and smooth convexly curved surface 36*a*. The laminated base member 30 and decorative plate 32 are pressed between the upper and lower molds 35 and 36 for a predetermined time and at a predetermined temperature and pressure. In this way, the base member 30 and decorative plate 32 are firmly joined together, via the adhesive 33, to thereby provide the side plate 23 arcuately curved in conformity with the pressing surfaces 35*a* and 36*a* of the upper and lower molds 35 and 36.

In the above description, the adhesive 33 is applied only to projecting portions of the outer surface of the base member 30. The adhesive 38 may also be applied so as to fill the grooves 31 of the base member 30. Alternatively, a material which improves rigidity or acoustic characteristics of the base member 30 may be filled in the grooves 31 instead of the adhesive 33.

For applying a filling material in the grooves 31, a foaming material may for instance be used so that the filling material is filled by heating after bonding. Alternatively, the base member 30 only may be previously bent and then a filling material may be applied and further the decorative plate 32 may be bonded to the base member 30.

As the side wall 23 is arcuately curved via the press forming machine in the abovedescribed manner, the base member 30 is curved along the pressing surface 36*a* of the lower mold 36 while the decorative plate 32 is curved along the pressing surface 35*a* of the upper mold 35. During that time, stress builds up concentratively in inner surface regions a (FIG. 3), near bottom side edges of the grooves 31, of inter-groove portions 30A (i.e., non-grooved portions between the grooves 31) of the base member 30, so that the base member 30 would be caused, by the stress, to undesirably bend in a substantial doglog fashion; that is, the base member 30 would not curve continuously arcuately. On the other hand, the decorative plate 32, which has no grooved portion, has considerable bending rigidity and is free of stress concentrating region, so that it can curve continuously arcuately with its entire outer surface held in close contact with the pressing surface 35*a* of the upper mold 35. Part of the inner surface (i.e., reverse surface) of the decorative plate 32 linearly contacts outer surface regions b, near the top side edges of the grooves 31, of the inter-groove portions 30A of the base member 30, and the remaining part of the inner surface of the decorative plate 32 arcuately floats above, i.e. do not directly contact, the outer surface of the inter-groove portions 30A. The part floating above the outer surface of the inter-groove portions 30A is bonded to the inter-groove portions 30A by the adhesive 33. Such arrangements of the present invention can reliably prevent the near-top-edge outer surface regions b of the curved base member 30 from appearing as creases on the outer surface of the decorative plate 32.

Figure 8:
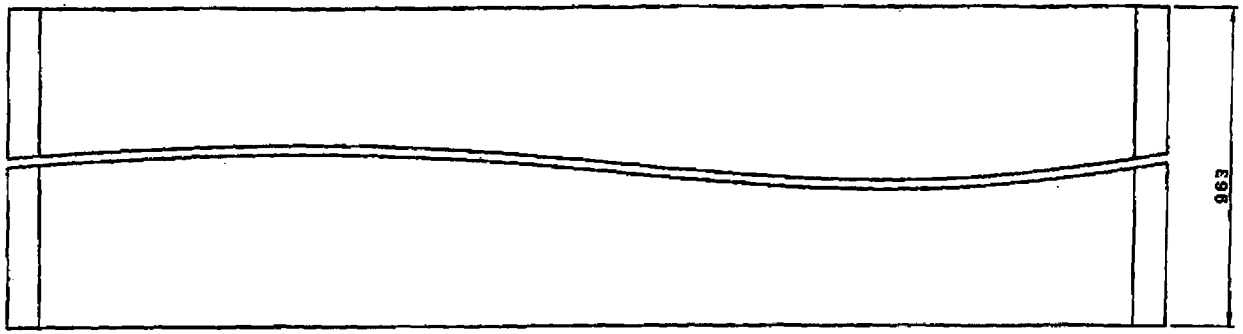
FIGS. 8–10 are views showing respective sizes of the side plate.
Figure 9:
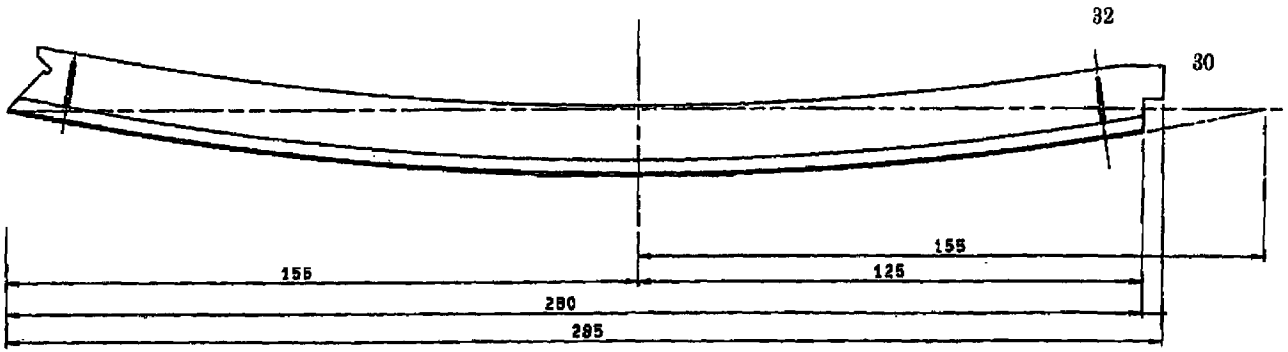
Figure 10:
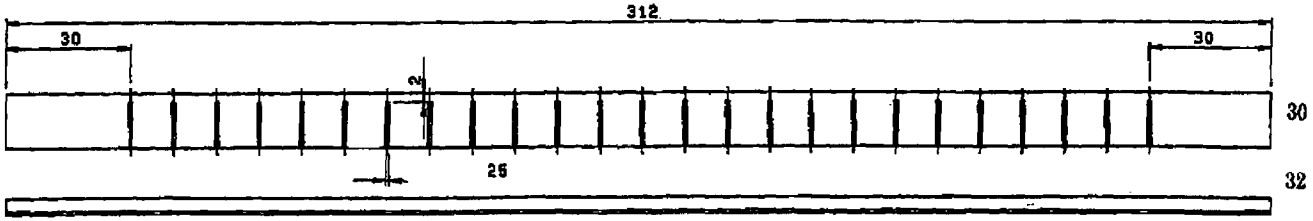

FIGS. 8–10 show respective sizes of the side plates 23. FIG. 8 shows the side plate 23 after bending as viewed from the side (corresponding to tho side plate 23 of FIG. 1). FIG. 9 shows the side plate 23 after bending as viewed from above. FIG. 10 shows the respective component plates before the side plate 23 is formed. In FIG. 10, thickness of the base member 30 is 12 mm whereas depth of the grooves 31 is 10 mm. The deeper the depth of the grooves 31, the more easily the base member 30 can be bent and, accordingly, the more easily the base member 30 and the decorative plate 32 can be fixed to each other during bonding. In each of the curved side plates 23 of the speaker cabinet 20, the base member 30 has the grooves 31 in its outer surface portion, and the decorative plate 32, having considerable bending rigidity, is adhesively bonded to the outer surface of the base member 30 in a laminated fashion in such a manner that the grooves 31 are covered with the decorative plate 32. Thus, assuming that the adhesive 33 has a sufficient adhesion force and that the cabinet board used in the instant embodiment is different from the conventional cabinet board 7 only in that the grooves 31 are formed in the obverse side of the base member 30 while the grooves 6 of the conventional cabinet board 7 are formed in the reverse side of the base member E;, the instant embodiment can provide a highly rigid, strong curved structure of the side plates 23 and thereby achieve enhanced shape stability of the speaker cabinet 20, because the opening edges (top side edges) of the grooves 31 are securely fixed to the underside of the decorative sheet 32.

Further, the instant embodiment can prevent the grooves 31 from varying in width due to resonance of the speaker cabinet 20, thereby significantly improving acoustic effects.

Furthermore, because tho decorative plate 32 is formed into a continuous, smooth convexly-curved surface by being curved along the pressing surface 35*a* of the upper mold 35, the instant embodiment can reliably prevent the near-top-edge outer surface regions b of the curved base member 30 from appearing as creases on the outer surface of the decorative plate 32, thereby achieving an improved outer appearance quality.

Whereas the preferred embodiment of the invention has been described above as in relation to the case where the side plates 23, constituting the left and right side surfaces of the speaker cabinet 20, are each formed into a convexly curved surface, the present invention is not so limited; for example, the front plate 21 and/or top plate 22 may be formed into a convexly curved surface.

In summary, the speaker cabinet of the present invention arranged in the above-described manner has high rigidity and shape stability and can improve acoustic characteristics, and, in addition, it can present a high-quality outer appearance with a smooth surface without any undesired crease on the surface of the decorative plate.

What is claimed is:

1. A speaker cabinet in which at least a part of an outer wall thereof is formed of a cabinet board curved to have a convexly curved outer surface, said cabinet board comprising:

a base member having a plurality of grooves formed at predetermined intervals in an outer surface portion thereof, said base member being convexly curved in a direction where the grooves open; and a decorative plate adhesively bonded to the outer surface of said base member, in a laminated fashion, so as to cover the grooves, wherein said decorative plate includes a veneer sheet and a decorative sheet, such that the decorative sheet is adhesively bonded to an outer surface of the veneer sheet, and an inner surface of the veneer sheet is adhesively bonded to the outer surface portion of said base member.

2. A method for forming a speaker cabinet in which at least a part of an outer wall thereof is formed of a cabinet board curved to have a convexly curved outer surface, said method comprising steps of:

forming a plurality of grooves at predetermined intervals in an outer surface portion of a base member;

forming a decorative plate by bonding a decorative sheet to an outer surface of a veneer sheet, such that an inner surface of the veneer sheet is adhesively bonded to said base member;

bonding the decorative plate adhesively to the outer surface of said base member, in a laminated fashion, so as to cover the grooves; and bending the base member and the decorative plate in such a manner that said base member is convexly curved in a direction where the grooves open.

* * * * *